US012324974B2

(12) United States Patent
Patel

(10) Patent No.: US 12,324,974 B2
(45) Date of Patent: Jun. 10, 2025

(54) BUILT-IN CARRIER STRAP FOR A YOGA/FITNESS MAT

(71) Applicant: Sheena Patel, Andover, MA (US)

(72) Inventor: Sheena Patel, Andover, MA (US)

( * ) Notice: Subject to any disclaimer, the term of this patent is extended or adjusted under 35 U.S.C. 154(b) by 77 days.

(21) Appl. No.: 18/189,595

(22) Filed: Mar. 24, 2023

(65) Prior Publication Data

US 2024/0316434 A1 Sep. 26, 2024

Related U.S. Application Data

(60) Provisional application No. 63/267,178, filed on Jan. 26, 2022.

(51) Int. Cl.
*A63B 71/00* (2006.01)
*A63B 21/00* (2006.01)

(52) U.S. Cl.
CPC ..... *A63B 71/0036* (2013.01); *A63B 21/4037* (2015.10)

(58) Field of Classification Search
CPC ..... A63B 21/00178; A63B 21/00047; A63B 21/4037; A63B 6/00; A63B 6/02; A63B 6/025; A63B 2210/50; A63B 71/0036
See application file for complete search history.

(56) References Cited

U.S. PATENT DOCUMENTS 6,751,816 B1 * 6/2004 Wechsler ..... A47G 9/062 383/4
7,007,322 B2 * 3/2006 Alane ..... A47G 27/0237 5/417
10,946,235 B2 * 3/2021 Ruse ..... A63B 71/0036
2009/0260157 A1 * 10/2009 Gere ..... A45C 9/00 5/417

* cited by examiner

*Primary Examiner* — Megan Anderson
*Assistant Examiner* — Jonathan A Dicuia
(74) *Attorney, Agent, or Firm* — Dunlap Bennett & Ludwig, PLLC

(57) ABSTRACT

A fitness mat having an intrinsic strap with two ends, each end is connected to a junction of a first and second fastening strap, respectively, by way of an anchor point, thereby defining an H-shape. Opposing distal ends of each fastening strap have complementary first and second connectors facing in opposite direction relative to the other fastening strap so that when the fitness mat is rolled to a furled condition, each pair of the first and second fastening straps can wrap about the rolled mat to secure it in the furled condition by way of the first and second connectors. The intrinsic strap is just inward of an edge of the fitness mat so that in the secured furled condition, the intrinsic strap can be used as a shoulder strap.

12 Claims, 3 Drawing Sheets

BUILT-IN CARRIER STRAP FOR A YOGA/FITNESS MAT

CROSS-REFERENCE TO RELATED APPLICATION

This application claims the benefit of priority of U.S. provisional application No. 63/267,178 filed Jan. 26, 2022, the contents of which are herein incorporated by reference.

BACKGROUND OF THE INVENTION

The present invention relates to yoga/fitness mats and, more particularly, a built-in carrier strap for a yoga/fitness mat.

There is no easy way to tote a yoga/fitness mat by itself as it tends to unfurl. To carry a yoga/fitness mat one needs to purchase additional accessories, such as a retaining and/or carrying apparatus, which includes either a yoga bag or a separate carrying strap. The problem with current retaining and carrying apparatuses is that one size does not fit all. Sometimes the carrying bag is too small for larger mats, or the carrying straps are too loose for smaller mats.

In short, current solutions are often too big, making it difficult to carry the yoga/fitness mat or allowing the yoga/fitness mat to unfurl too easily. Accordingly, current carrying accessories do not work well because they are not intrinsic to the fitness mat, and thus one has to buy and carry a different carrying apparatus for each different size of fitness mat.

As can be seen, there is a need for a built-in carrier strap for a yoga/fitness mat. The present invention embodies a strap built into—and thus is an intrinsic portion of—the fitness mat, thereby a user does not need to purchase additional accessories to carry the mat. The present invention described herein reduces the number of additional accessories one has to purchase to carry their yoga/fitness mat, while also streamlining the carrying of the mat as the intrinsic strap is dimensioned and adapted to fit its mat.

SUMMARY OF THE INVENTION

In one aspect of the present invention, a fitness mat having an intrinsic strap, the fitness mat including the following: two sets of first and second fastening straps spaced apart along a first surface of the fitness mat; each end of the intrinsic strap is anchored at an anchor point to a junction of one of the two sets of first and second fastening straps; and a first connector and a second connector on a distal end of each first and second fastening strap, respectively, wherein the first and second connectors face opposing directions so that when the fitness mat is moved to a furled condition, each set of first and second fastening straps is independently movable to wrap around the furled condition and engage the first and second connectors.

In another aspect of the present invention, the fitness mat further includes wherein the first fastening strap is connected to the first surface beyond the anchor point so that the first connector is fixed relative to the first surface, wherein the first and second fastening straps are a single strap, wherein the second fastening straps are fixed to the first surface only at the anchor point so that the second connector is movable relative to the first surface, and wherein for each set, the first and second fastening straps are colinearly oriented, whereby the two sets of first and second fastening and the intrinsic strap define an H-shape.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a fitness mat having an intrinsic strap with two ends, each end is connected to a junction of a first fastening strap and a second fastening strap, respectively, by way of an anchor point, thereby defining an H-shape. Opposing distal ends of each fastening strap have complementary connectors facing in opposite direction so that when the fitness mat is rolled to a furled condition, each pair of the first and second fastening straps can partial wrap about the rolled mat to mate the complementary connectors, thereby securing the fitness mat in the furled condition. In the secured furled condition, the intrinsic strap can be used as a shoulder strap.

Figure 1:
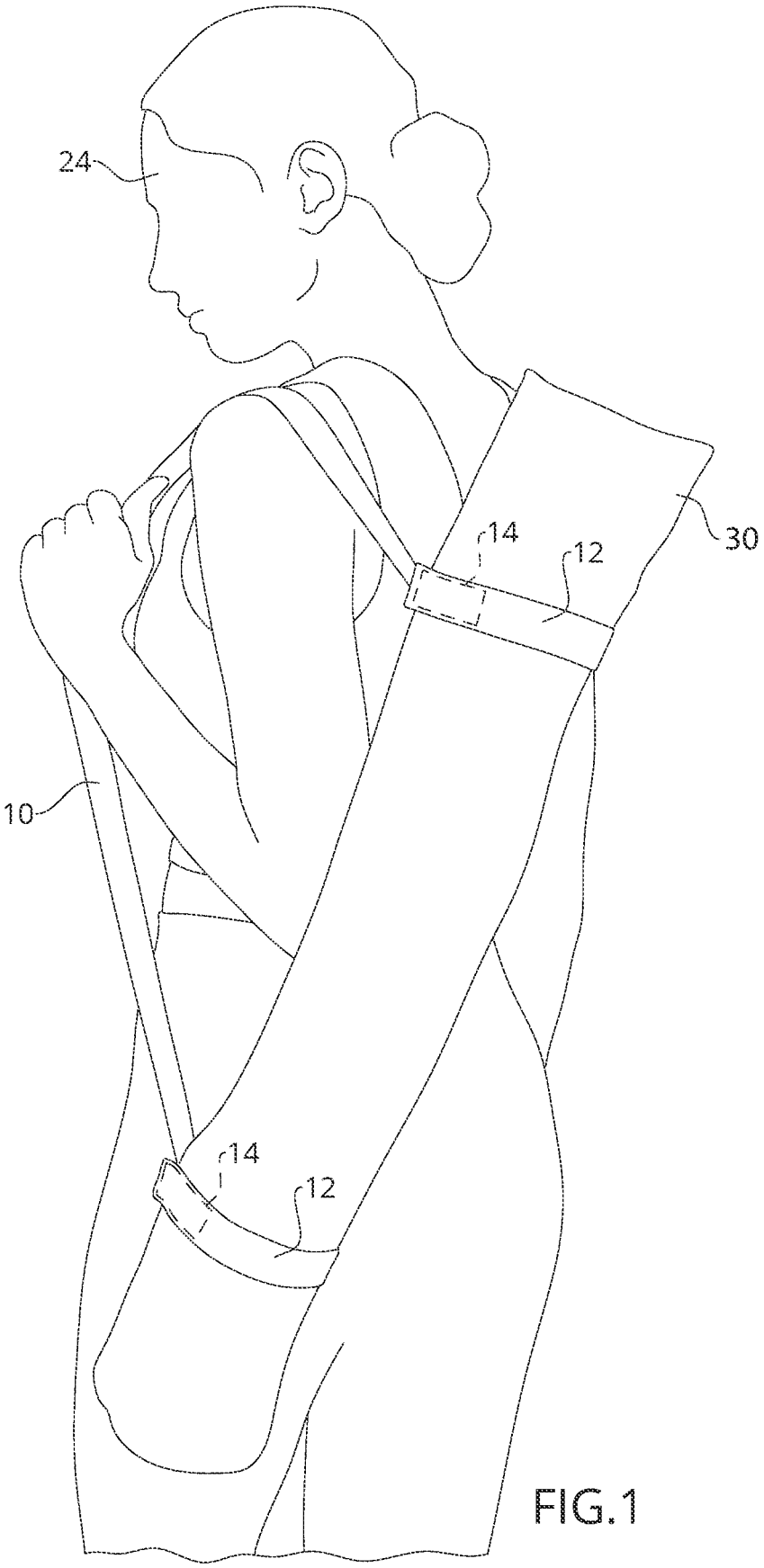
FIG. 1 is a side perspective view of an exemplary embodiment of the present invention, shown in use.
Figure 5:
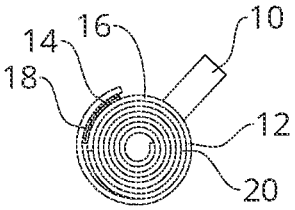
FIG. 5 is a side elevation view of an exemplary embodiment of the present invention, shown in a furled condition.
Figure 6A:
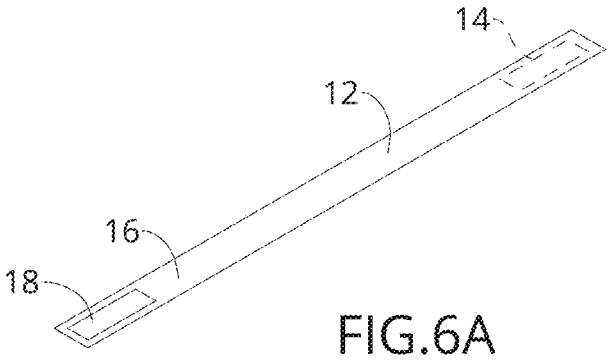
FIG. 6A is a detailed perspective view of an exemplary embodiment of a unitary fastening strap of the subject disclosure, having a first portion 12 and a second portion 16 thereof.
Figure 6B:
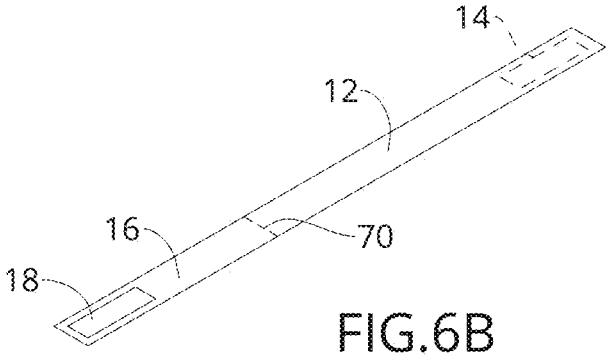
FIG. 6B is a detailed perspective view of an exemplary embodiment of a fastening strap of the subject disclosure having two separate strap portions 12 and 16 that are engageable or adjacent to each other at a junction 70. This junction 70 may be where the anchor point 26 is located. It is understood that the junction 70 is not necessarily located only at the location shown on FIG. 6B but can be closer to either distal end of the fastening strap.

Referring to FIGS. 1 and 5, the present invention may include an intrinsic strap 10 for a fitness mat 30.

Figure 3:
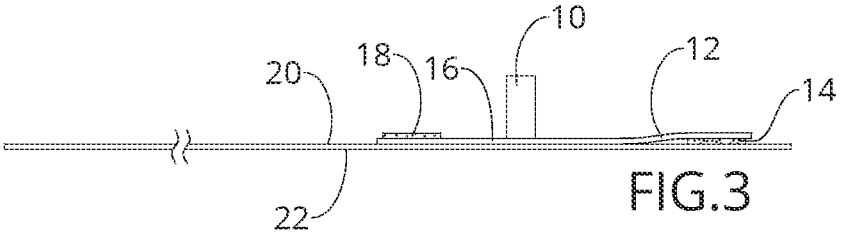
FIG. 3 is a side elevation view of an exemplary embodiment of the present invention, shown in a flat condition.

The fitness mat 30 is a generally planar sheet of material, and typically has a longitudinal length greater than its width (in FIG. 3, the length is shown extending left to right). The edges of the length and the width define two opposing supportive surfaces: a first surface 20 and a second surface 22.

The intrinsic strap 10 may be made of malleable, flexible elastic material, natural or synthetic. The intrinsic strap 10 may extend widthwise relative to the first surface 20. The intrinsic strap 10 may be generally parallel an adjacent width edge and offset therefrom a distance that, depending on embodiments, may be between one inch to twelve inches.

Figure 2:
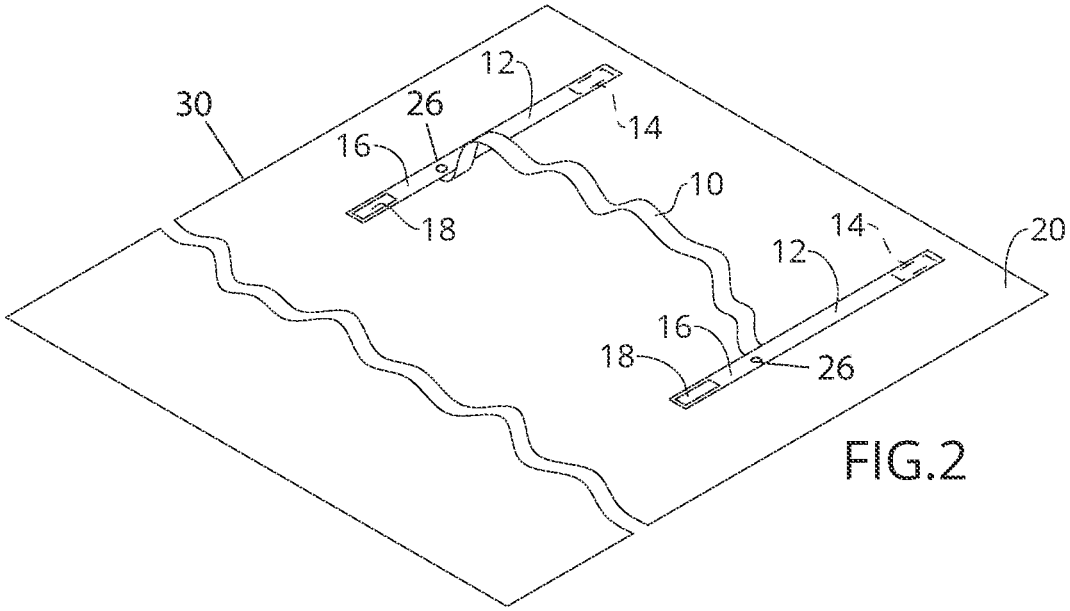
FIG. 2 is a top perspective view of an exemplary embodiment of the present invention.

The intrinsic strap 10 is only connected to the first surface 20 at its two ends. Each end terminates inward of the two opposing longitudinal edges, respectively. Each end is anchored to the first surface 20 at the junction of a first fastening strap 12 and a second fastening strap 16. The first and second fastening straps 12 and 16 are colinearly oriented relative to each other and are oriented orthogonally or transversely relative to the intrinsic strap 10, as illustrated in FIG. 2. As a result, the arrangement of the two pairs of first and second fastening straps 12 and 16 and the intrinsic strap 10 may define an H-shape, though the present invention contemplates various shapes for the intrinsic strap and fastener strapping assembly as long as the ends of the intrinsic strap 10 are anchored in the junction point of the respective first and second fastener strap 12 and 16. This arrangement is critical because (1) it balances the weight of the mat 30 so that it's easier to carry on the shoulder of the user 24 in a vertical position, and (2) it keeps the material of the strap wide so it does not feel (to the user) like the user 24 is stepping on the material of the strap 10, even when it's underneath the user when using the mat 30.

Each distal end of each first and second fastening straps 12 and 16 provides a first connector 14 and second connector 18, respectively, wherein the proximal ends of the first and second fastening straps 12 and 16 defines the junction that is anchored with one end of the intrinsic strap 10. The first and second connectors 14 and 18 may be complementary detachable fasteners, such as but not limited to hook and loop fasteners, adhesives, snaps, etc. Importantly, for the first fastening strap 12, the first connector 14 is on an opposing side compared to the second connector 18 of the second fastening strap 16. It is understood that even though the drawings indicate that the first connector 14 faces the first surface 20, it may be facing upward, while the second connector 18 faces the first surface 20 even though it is shown opposite in the attached Figures.

Figure 4:
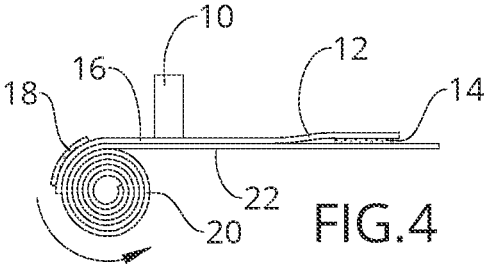
FIG. 4 is a side elevation view of an exemplary embodiment of the present invention, illustrating a furling motion of the mat.

In some embodiments, the first fastening strap 12 is fixed to the first surface 20, while the second fastening strap 16 is only fixed at its junction/anchor point 26, enabling its distal end to pivot and/or move relative the anchor point 26. In some embodiments, the second fastening strap 16 is fixed, while first fastening strap 12 is free to move about its anchor point 26. In any event, as a result, when the fitness mat 30 is rolled up, as illustrated in FIGS. 4 and 5, the opposing ends of the first and second fastening straps 12 and 16 can fastener to each other, thereby maintaining the furled condition even when the fitness mat 30 is being carried by a user 24 by way of the intrinsic strap 10, as illustrated in FIG. 1.

An anchor point 26 may join the intersection of the proximal end of each fastening strap 12 and 16 as well as the end of the intrinsic strap 10 to the first surface 20. In some embodiments, the first and second fastening straps 12 and 16 may be a single strap that is anchored down to the fitness mat 30 by the anchor point 26. A joining method for the anchor point 26 may include, but is not limited to, stitching. In some embodiments, the intrinsic strap 10 may be stitched to the second surface 22 of the fitness/yoga mat 30.

In some embodiments, the fitness mat 30 may have a rubberized back or other anti-skid of slip-proof element on the end of the first surface 20 opposite the intrinsic strap 10. In certain embodiments, the second surface 22 of the fitness mat 10 may also have a thin coating of organic tree rubber applied thereto, or other material that enables the anti-skid properties.

During manufacture, guidelines could be placed on the type of material used for the strap to match the material and feel of the host fitness/yoga mat 30. The components or elements can be shuffled or interchanged or reconfigured on how the straps are stitched on the mat itself and where exactly the adhesive material is placed on the fabric strap itself. The strap can be placed anywhere on the mat the back or front.

A method of using the present invention may include the following. The intrinsic strap 10 disclosed above may be provided on a fitness mat 30 by way of the anchoring point 26. The fitness mat 30 may be rolled and the unattached parts of the first fastening strap 12 wrapped around the fitness mat 30 and then the complementary detachable fasteners 24 and 18 are joined, securing the fitness mat 30 in a rolled condition. Once in this secured position, then the user can use the intrinsic strap 10 to easily carry the mat 30. Additionally, this type of in-built carrying strap can be used for any large furlable sheet of material one wants to easily carry including blankets, camping flooring, etc.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the present invention.

What is claimed is:

1. A fitness mat comprising:

an intrinsic strap;

two fastening straps spaced apart along a first surface of the fitness mat;

each fastening strap comprises a first strap portion and a second strap portion;

each end of the intrinsic strap is permanently anchored only at an anchor point directly connected to a junction of a respective fastening strap of the two fastening straps, wherein respective proximal ends of the first and second strap portions adjacent each other; and on each of the two fastening straps, a first connector and a second connector is on a distal end of each first and second strap portions, respectively, wherein the first and second connectors face opposing directions so that when the fitness mat is moved from a flat condition to a furled condition, each set of first and second fastening straps is independently movable to wrap around the furled condition and engage the first and second connectors, whereby the two fastening straps and the intrinsic strap define an H-shape along one surface of the fitness mat in the flat condition.

2. The fitness mat of claim 1, wherein for each fastening strap of the two fastening straps, the first strap portion is connected to the first surface beyond along a substantial portion of a length thereof, while the second strap portion is connected to the first surface only at the anchor point so that the first connector is fixed relative to the first surface, while the second connector is movable about the anchor point relative the first surface.

3. The fitness mat of claim 2, wherein for each fastening strap of the two fastening straps the first and second strap portions are separate straps.

4. The fitness mat of claim 1, wherein for each fastening strap of the two fastening straps the second strap portions are fixed to the first surface only at the anchor point so that the second connector is movable about the anchor point relative to the first surface.

5. The fitness mat of claim 4, wherein for each fastening strap the first and second strap portions are colinearly oriented.

6. The fitness mat of claim 1, further comprising an anti-skid element on an end of the first surface opposite the intrinsic strap.

7. The fitness mat of claim 1, for each fastening strap of the two fastening straps, the proximal ends of the first and second strap portions are joined by only the anchoring point.

8. A fitness mat comprising:

an intrinsic strap;

two fastening straps spaced apart along a first surface of the fitness mat;

each end of the intrinsic strap is permanently anchored only at an anchor point directly connected to a junction of a respective fastening strap of the two fastening straps; and on each of the two fastening straps, a first connector and a second connector is on a distal end of each first and second strap portions, respectively, wherein the first and second connectors face opposing directions so that when the fitness mat is moved from a flat condition to a furled condition, each set of first and second fastening straps is independently movable to wrap around the furled condition and engage the first and second connectors, whereby the two fastening straps and the intrinsic strap define an H-shape along one surface of the fitness mat in the flat condition.

9. The fitness mat of claim 8, wherein for each fastening strap of the two fastening straps, a first portion is connected to the first surface along a substantial portion of a length thereof, while the second portion is connected to the first surface only at the anchor point so that the first connector is fixed relative to the first surface, while the second connector is movable about the anchor point relative the first surface.

10. The fitness mat of claim 9, wherein each fastening strap of the two fastening straps is a single strap.

11. The fitness mat of claim 8, wherein for each fastening strap of the two fastening straps the second portions are fixed to the first surface only at the anchor point so that the second connector is movable about the anchor point relative to the first surface.

12. The fitness mat of claim 8, further comprising an anti-skid element on an end of the first surface opposite the intrinsic strap.

* * * * *